US006752130B2

(12) United States Patent
Schueler et al.

(10) Patent No.: US 6,752,130 B2
(45) Date of Patent: Jun. 22, 2004

(54) FUEL INJECTION SYSTEM FOR AN INTERNAL COMBUSTION ENGINE

(75) Inventors: Peter Schueler, Leonberg (DE); Werner Bruehmann, Stuttgart (DE); Kurt Frank, Schorndorf (DE); Stefan Kieferle, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 37 days.

(21) Appl. No.: 10/291,609

(22) Filed: Nov. 12, 2002

(65) Prior Publication Data

US 2003/0111052 A1 Jun. 19, 2003

(30) Foreign Application Priority Data

Nov. 16, 2001 (DE) ..... 101 56 408

(51) Int. Cl.[7] ..... F02M 37/04
(52) U.S. Cl. ..... 123/514; 123/510
(58) Field of Search ..... 123/510, 511, 123/514

(56) References Cited

U.S. PATENT DOCUMENTS 4,454,851 A * 6/1984 Bourbonnaud et al. ..... 123/514
4,617,116 A * 10/1986 Seiler ..... 123/514
4,893,603 A * 1/1990 Siebels ..... 123/514
5,085,198 A * 2/1992 Bartlett et al. ..... 123/510
5,195,494 A * 3/1993 Tuckey ..... 123/514
5,263,456 A * 11/1993 Owen-Evans ..... 123/495
5,551,404 A * 9/1996 Bauerle et al. ..... 123/514
5,794,598 A * 8/1998 Janik et al. ..... 123/514
6,398,119 B1 * 6/2002 Duffer et al. ..... 236/93 A

* cited by examiner

*Primary Examiner*—Thomas N. Moulis
(74) *Attorney, Agent, or Firm*—Ronald E. Greigg

(57) ABSTRACT

A fuel injection system having a prefeed pump, through which fuel from a fuel supply container is pumped to a high-pressure pump, and by means of the high-pressure pump, fuel is pumped into a reservoir. Communicating with the reservoir is at least one injector, through which fuel is injected to the engine. A fuel filter is disposed between the prefeed pump and the high-pressure pump. A return line for uninjected fuel leads back from at least one injector into a region upstream of the high-pressure pump. A valve is provided, by which the return line, in a first switching position, at a low fuel temperature, leads to upstream of the fuel filter, between it and the prefeed pump, and by which the return line, in a second switching position, at a high fuel temperature, leads to downstream of the fuel filter, between it and the high-pressure pump.

16 Claims, 1 Drawing Sheet

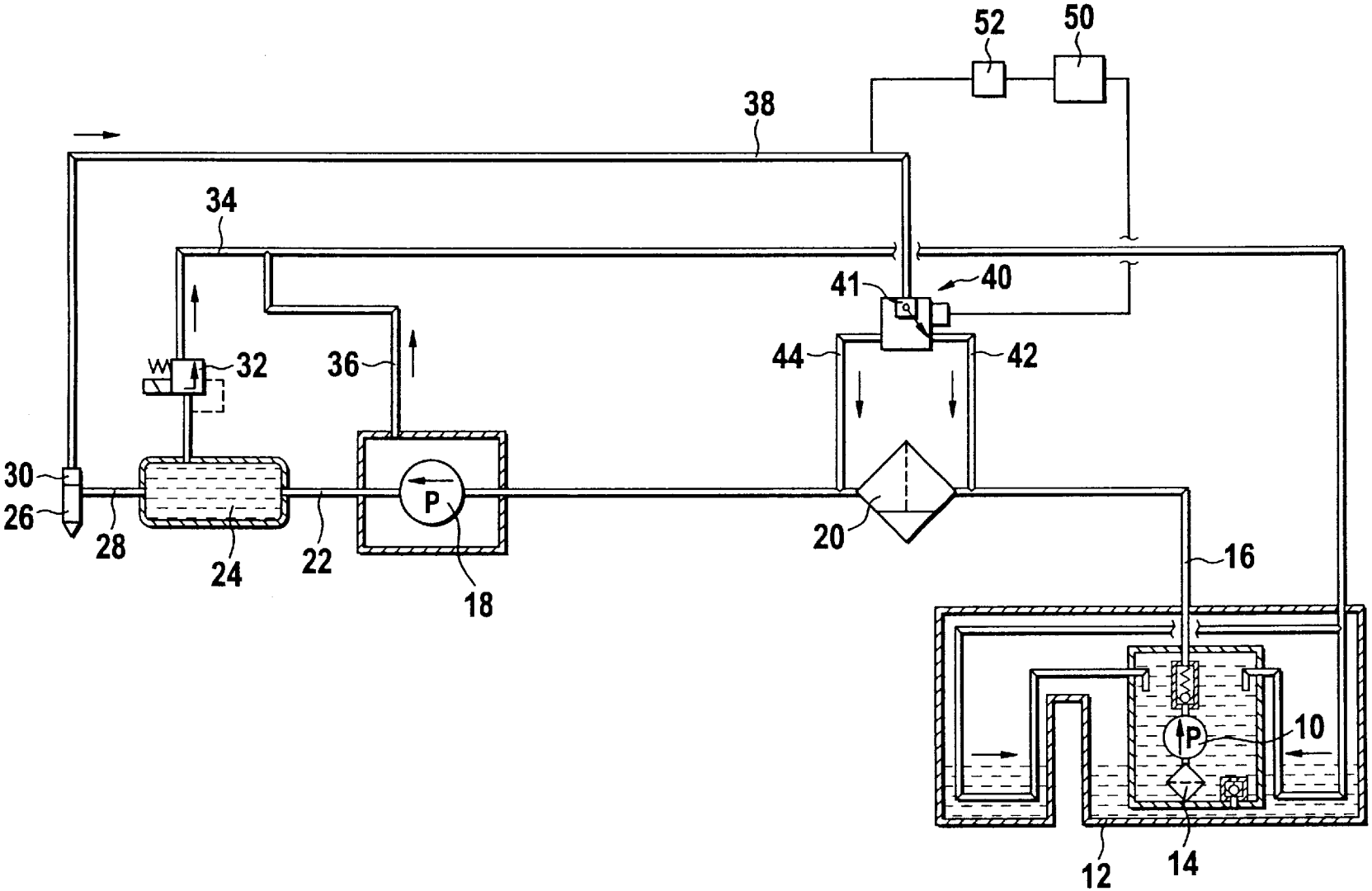
10
12
14
16
18
20
22
24
26
28
30
32
34
36
38
40
41
42
44
50
52
P
P

FUEL INJECTION SYSTEM FOR AN INTERNAL COMBUSTION ENGINE

BACKGROUND OF THE INVENTION

1. Field of the Invention

The invention is directed to an improved a fuel injection system for an internal combustion engine.

2. Description of the Prior Art

One fuel injection system of the type with which this invention is concerned is known from the literature, such as *Dieselmotor-Management* [Diesel Engine Management], published by Verlag Vieweg, 2nd Edition, 1998, page 262. This fuel injection system has a prefeed pump, through which fuel from a fuel supply container is pumped to a high-pressure pump. By the high-pressure pump, fuel is pumped into a reservoir, communicating with which are injectors through which fuel is injected into the engine. Between the prefeed pump and the high-pressure pump is a fuel filter. A return line for uninjected fuel from the injectors is provided, which discharges into the fuel supply container and thus into a region upstream of the high-pressure pump. A disadvantage of this is that a high fuel quantity must constantly be aspirated by the prefeed pump, yet some of this has to be returned to the fuel supply container again. The prefeed pump must therefore be made correspondingly large.

OBJECT AND SUMMARY OF THE INVENTION

The fuel injection system of the invention has the advantage over the prior art that because of the return of uninjected fuel by the prefeed pump to between the prefeed pump and the high-pressure pump, a smaller fuel quantity has to be pumped, and so the pump can be made correspondingly smaller. The valve moreover makes it possible for the returned fuel to be introduced selectively upstream or downstream of the fuel filter.

Other advantageous features and refinements of the fuel injection system of the invention are disclosed. By means of one embodiment, damage to the fuel filter from severe heating can be averted. Another embodiment makes rapid heating of the fuel filter possible, which particularly at low ambient temperatures prevents the fuel filter from becoming clogged with congealed fuel. The valve can furthermore be controlled as a function of engine operating parameters.

BRIEF DESCRIPTION OF THE DRAWING

The invention will be better understood and further objects and advantages thereof will become more apparent from the ensuing detailed description of a preferred embodiment taken in conjunction with the sole drawing FIGURE which schematically shows the improved fuel injection system for an internal combustion engine of a motor vehicle.

DESCRIPTION OF THE PREFERRED EMBODIMENTS

In the drawing, a fuel injection system for an internal combustion engine, for instance of a motor vehicle, is shown. The engine is preferably a self-igniting internal combustion engine and has one or more cylinders. The fuel injection system has a prefeed pump 10, which is disposed for instance in a fuel supply container 12 of the motor vehicle, but it can also be disposed outside the container 12. The prefeed pump 10 can have an electric drive motor, and for instance via a prefilter 14, it aspirates fuel from the fuel supply container 12. The prefeed pump 10 can also be driven mechanically by the engine, for instance. From the outlet of the prefeed pump 10, a line 16 leads to a high-pressure pump 18. Between the prefeed pump 10 and the high-pressure pump 18, a fuel filter 20 is disposed in the line 16; it is embodied as a fine filter and is bathed by the fuel pumped by the prefeed pump 10.

The high-pressure pump 18 has a plurality of pump elements, for instance, each of which has a piston that is guided in a cylinder bore and is driven to execute a reciprocating motion. The high-pressure pump 18 is preferably driven mechanically by the engine. The fuel pumped by the high-pressure pump 18 is delivered via a line 22 to a reservoir 24. For each cylinder of the engine, one injector 26 is provided, through which fuel is injected into the combustion chamber of the cylinder. Each injector 26 communicates via a line 28 with the reservoir 24, and the opening of the injector 26 for injecting fuel is controlled by an electrically triggered valve 30.

Controlling and/or limiting the pressure prevailing in the reservoir 24 is a pressure control valve 32, which opens if a predetermined pressure is exceeded and thus in turn opens a fuel return, via a line 34, from the reservoir 24 into the fuel supply container 12. At the high-pressure pump 18, a return line 36 may be provided, by way of which a leakage quantity of fuel can for instance flow out and which can discharge into the line 34.

Via a line 38, a fuel return also leads away from the injectors, and carries away uninjected fuel. The return line from the injectors 26 does not, however, lead into the fuel supply container 12 but rather into a region between the prefeed pump 10 and the high-pressure pump 18. A valve 40 is provided in the return line 38, through which the return line 38, in a first switching position, discharges upstream of the fuel filter 20, between it and the prefeed pump 10, and by which the return line 38, in a second switching position, discharges downstream of the fuel filter 20, between it and the high-pressure pump 18. A line 42 that discharges upstream of the fuel filter 20 and a line 44 that discharges downstream of the fuel filter 20 lead away from the valve 40. The lines 42, 44 can discharge into the line 16 or can discharge directly at a housing of the fuel filter 20. The valve 40 can be embodied as a 3/2-way valve, by which, in the first switching position, the return line 38 communicates with the line 42 and is disconnected from the line 44, and by which, in the second switching position, the return line 38 communicates with the line 44 and is disconnected from the line 42.

The valve 40 can be embodied as an electrically triggered valve, which for instance has an electromagnetic actuator that is triggered by a control device 50 of the fuel injection system. Provision may be made so that the temperature of the fuel flowing through the return line 38 is detected by a sensor device 52; the sensor device 52 communicates with the control device 50. By means of the control device 50, the valve 40 is triggered in such a way that at a low temperature, it assumes its first switching position, so that the return line 38 discharges upstream of the fuel filter 20, and the returned fuel flows through the fuel filter 20. At a high fuel temperature, the valve 40 is put by the control device 50 into its second switching position, so that the return line 38 discharges downstream of the fuel filter 20, and the returned fuel does not flow through the fuel filter 20. Alternatively, it can also be provided that the valve 40 itself has a temperature-sensitive element 41, which is exposed to the fuel flowing through the return line 38, and by means of which the switching of the valve 40 is effected such that the valve assumes its first switching position at a low fuel temperature and its second switching position at a high fuel temperature. The temperature-sensitive element 41 may for instance be a strain gauge or a bimetallic element, which deforms as a function of the temperature and controls the applicable connections in the valve 40.

It can also be provided that upon starting of the engine the valve 40 is put into its first switching position by the control device 50, so that the heated fuel, returned through the return line 38, flows through the fuel filter 20 and heats it. This is advantageous particularly at a low ambient temperature, to prevent the fuel filter 20 from stopping up if thickening of the fuel can occur.

The valve 40 can also be switched over between its two switching positions as a function of at least one engine operating temperature. As an alternative to the electrical actuation explained above, the valve 40 may also be actuated pneumatically or hydraulically.

The foregoing relates to a preferred exemplary embodiment of the invention, it being understood that other variants and embodiments thereof are possible within the spirit and scope of the invention, the latter being defined by the appended claims.

We claim:

1. A fuel injection system for an internal combustion engine, the injection system comprising, a high pressure pump (18), a prefeed pump (10) by which fuel is pumped out of a fuel supply container (12) to the high-pressure pump (18), a reservoir (24) connected to the high pressure pump (18) for receiving the high-pressure fuel, at least one injector communicating with the reservoir (24) for injecting fuel into the engine, a fuel filter (20), disposed between the prefeed pump (10) and the high-pressure pump (18), a return line (38) for uninjected fuel leads back from at least one injector (26) into a region upstream of the high-pressure pump (18), and a valve (40) connected in the return line (38), the valve (40) being operable in a first switching position to connect the return line (30) at a position upstream of the fuel filter (20), between the filter and the prefeed pump (10), and a second switching piston connecting the return line (38), to the return line (38) downstream of the fuel filter (20), between it and the high-pressure pump (18).

2. The fuel injection system according to claim 1 wherein the valve (40) is controlled as a function of the temperature of the returned fuel in such a way that at a low fuel temperature it assumes its first switching position, so that the return line (38) leads to upstream of the fuel filter (20), and at a high fuel temperature it assumes its second switching position, so that the return line (38) leads to downstream of the fuel filter (20).

3. The fuel injection system according to claim 1 wherein the valve (40), upon starting of the engine, is put into its first switching position so that the return line (38) leads to upstream of the fuel filter (20).

4. The fuel injection system according to claim 2 wherein the valve (40), upon starting of the engine, is put into its first switching position so that the return line (38) leads to upstream of the fuel filter (20).

5. The fuel injection system according to claim 1 wherein the valve (40) is switched between its two switching positions as a function of at least one operating parameter of the engine.

6. The fuel injection system according to claim 2 wherein the valve (40) is switched between its two switching positions as a function of at least one operating parameter of the engine.

7. The fuel injection system according to claim 3 wherein the valve (40) is switched between its two switching positions as a function of at least one operating parameter of the engine.

8. The fuel injection system according to claim 4 wherein the valve (40) is switched between its two switching positions as a function of at least one operating parameter of the engine.

9. The fuel injection system according to claim 1 further comprising a fuel return line (34; 36) leading from a pressure control valve (32) of the reservoir (24) and/or from the high-pressure pump (18) into the fuel supply container (12), bypassing the valve (40).

10. The fuel injection system according to claim 2 further comprising a fuel return line (34; 36) leading from a pressure control valve (32) of the reservoir (24) and/or from the high-pressure pump (18) into the fuel supply container (12), bypassing the valve (40).

11. The fuel injection system according to claim 3 further comprising a fuel return line (34; 36) leading from a pressure control valve (32) of the reservoir (24) and/or from the high-pressure pump (18) into the fuel supply container (12), bypassing the valve (40).

12. The fuel injection system according to claim 4 further comprising a fuel return line (34; 36) leading from a pressure control valve (32) of the reservoir (24) and/or from the high-pressure pump (18) into the fuel supply container (12), bypassing the valve (40).

13. The fuel injection system according to claim 5 further comprising a fuel return line (34; 36) leading from a pressure control valve (32) of the reservoir (24) and/or from the high-pressure pump (18) into the fuel supply container (12), bypassing the valve (40).

14. The fuel injection system according to claim 6 further comprising a fuel return line (34; 36) leading from a pressure control valve (32) of the reservoir (24) and/or from the high-pressure pump (18) into the fuel supply container (12), bypassing the valve (40).

15. The fuel injection system according to claim 7 further comprising a fuel return line (34; 36) leading from a pressure control valve (32) of the reservoir (24) and/or from the high-pressure pump (18) into the fuel supply container (12), bypassing the valve (40).

16. The fuel injection system according to claim 8 further comprising a fuel return line (34; 36) leading from a pressure control valve (32) of the reservoir (24) and/or from the high-pressure pump (18) into the fuel supply container (12), bypassing the valve (40).

* * * * *